US005582776A

United States Patent [19]

Crawley et al.

[11] Patent Number: 5,582,776

[45] Date of Patent: Dec. 10, 1996

[54] APPARATUS FOR GENERATING FOAM

[75] Inventors: Harry D. Crawley, Dugald; Kenneth C. Rigney, Winnipeg, both of Canada

[73] Assignee: The Snuffer Corporation, Winnipeg, Canada

[21] Appl. No.: 413,211

[22] Filed: Mar. 28, 1995

[51] Int. Cl.[6] ..... B01F 3/04

[52] U.S. Cl. ..... 261/18.1; 169/15; 261/DIG. 26

[58] Field of Search ..... 261/DIG. 26; 169/15; 261/18.1

[56] References Cited

U.S. PATENT DOCUMENTS

| | | | |
|---|---|---|---|
| 2,164,153 | 6/1939 | Friedrich | 261/DIG. 26 |
| 2,201,040 | 5/1940 | Hansen-Ellehammer | 261/DIG. 26 |
| 2,934,149 | 4/1960 | Bedford et al. | 261/DIG. 26 |
| 2,990,380 | 6/1961 | Auerbach et al. | 261/DIG. 26 |
| 4,027,993 | 6/1977 | Wolff | 261/DIG. 26 |
| 4,366,081 | 12/1982 | Hull | 261/DIG. 26 |
| 4,474,680 | 10/1984 | Kroll | 261/DIG. 26 |
| 4,729,434 | 3/1988 | Rohrbach | 169/15 |
| 5,255,747 | 10/1993 | Teske et al. | 169/15 |
| 5,427,181 | 6/1995 | Laskaris et al. | 169/15 |
| 5,480,597 | 1/1996 | Ishida et al. | 261/DIG. 26 |

FOREIGN PATENT DOCUMENTS

| | | | |
|---|---|---|---|
| 1005231 | 2/1977 | Canada . | |
| 424995 | 3/1935 | United Kingdom | 169/15 |

*Primary Examiner*—Tim R. Miles

*Attorney, Agent, or Firm*—Adrian D. Battison; Murray E. Thrift

[57] ABSTRACT

An apparatus for generating foam includes a power source such as an internal combustion engine mounted in a frame for portable transportation of the apparatus. The power source drives an air compressor through an electric clutch which can disconnect the air compressor and a water pump. The water pump generates flow of the water under pressure through a duct system either to a water discharge valve or to a foam discharge valve. The foam is generated by injecting into the water stream a surfactant which is injected by reciprocating valve arrangement operated by flow of the water. The flow is controlled by a maximum flow orifice, a minimum flow orifice and an adjustable valve. The air compressor supplies a surge tank and the air is passed from the surge tank through a pressure regulator to a mixing device where the water and surfactant is mixed with the air to generate the foam. The mixing chamber comprises a vertical tube with a central shaft carrying a plurality of conical shaped baffles in spiral arrangement around the shaft.

17 Claims, 5 Drawing Sheets

APPARATUS FOR GENERATING FOAM

BACKGROUND OF THE INVENTION

This invention is directed at the production of foam for the purpose of fire prevention and suppression. More particularly it is directed at the method and apparatus for making compressed air foam to be used in stationary or portable fire fighting systems and emergency response units. The system is particularly applicable to portable systems used in forestry, structure protection, rural and urban grass fires (Class A fires), and oil and gas fires (Class B fires).

For some time foaming agents have been used to increase the effectiveness of water in the prevention and suppression of fires. Systems have traditionally used foaming .agents, commonly known as surfactants, mixed in holding tanks or introduced into the water stream by a variety of methods. More recently systems have been developed which also provide for the injection of compressed air into the water/surfactant mixture to provide an improved quality and volume of foam.

Some apparatus for metering the surfactant into the water and injecting the air into the said mixture have been developed but these systems have been large, complex, difficult to operate and in general did not give adequate control over water, surfactant, and air volumes.

The weight and size of the apparatus and the operational difficulties associated with them have caused the technology to be ignored in many instances where the use of Compressed Air Foam (CAF) could be very beneficial in the prevention and suppression of fires.

The apparatus have in general been too heavy and too difficult to operate for forestry applications as the equipment must be transported into remote areas, often by helicopter, and are operated by relatively untrained personnel. Although senior forestry officials have understood the benefits of CAF systems for some time, implementation of the technology has been very slow because of these problems.

Rural fire departments have had problems for many years with the distances they must travel to reach fires. This problem is becoming worse as rural populations decrease and pressure on financial resources increase. There has been some recognition that CAF systems could be beneficial in addressing these problems as they provide a method of utilizing smaller and more economical equipment which could be spread more evenly over the area. As in the forestry sector, however, the CAF systems were too big, too expensive, and too difficult to operate for widespread use.

With the rural depopulation referred to above farms have become larger and more capital intensive. With investments in buildings and equipment often reaching into the millions of dollars, depending on volunteer fire departments located many miles away no longer makes economic sense. Also, because of the scarcity of water in many locations a fire truck maintained on site is often not effective. CAF systems address the issue of water shortage as they extend the fire fighting capabilities of water by from six to twenty times. As with the previous market areas existing CAF systems were too expensive, to complicated, and too large for widespread use.

Many resorts are located in remote locations have similar fire protection problems to large farms. In addition they must often contend with forest fires. Although these resorts usually do not have the resources to maintain their own full scale fire departments, they must upgrade their fire fighting capabilities. Again, CAF units offer the capabilities required provided the aforementioned problem areas are resolved.

SUMMARY OF THE INVENTION

The invention described herein provides a lightweight CAF unit which offers precise water, foam, and air control with a simple control arrangement. Because of the simple nature of the product it will be inexpensive enough to be economically viable in a wide variety of applications. The light weight and small size of the unit make it ideal for movement by light truck, trailer, helicopter or boat.

The preferred embodiment described hereinafter involves concepts not previously known to address the problems stated including: the use of two fixed diameter orifices and an adjustable water control valve to control the amount of water required for wet, medium and dry consistency foam; a direct acting hydraulic powered foam injector to provide precise surfactant injection in a lightweight economical package; a multi piston single stage compressor with an integral electric clutch to provide easily controllable air injection which can be turned off when not required allowing the unit to remain in a standby mode or to operate in a water-only mode; an air receiver tank to eliminate pulsing of the air supply; a removable stationary agitator consisting of a shaft with conical agitating discs radially arranged on the shaft in a spiral pattern with the point of the cones directed opposite the fluid flow, centrally, located within the pipe in which the water/surfactant/air mixture is flowing; and a water by-pass circuit to allow the simultaneous pumping of foam and plain water.

One embodiment of the invention will now be described in conjunction with the accompanying drawings in which:

BRIEF DESCRIPTION OF THE DRAWING

In the drawings like characters of reference indicate corresponding parts in the different figures.

DETAILED DESCRIPTION

Figure 3:
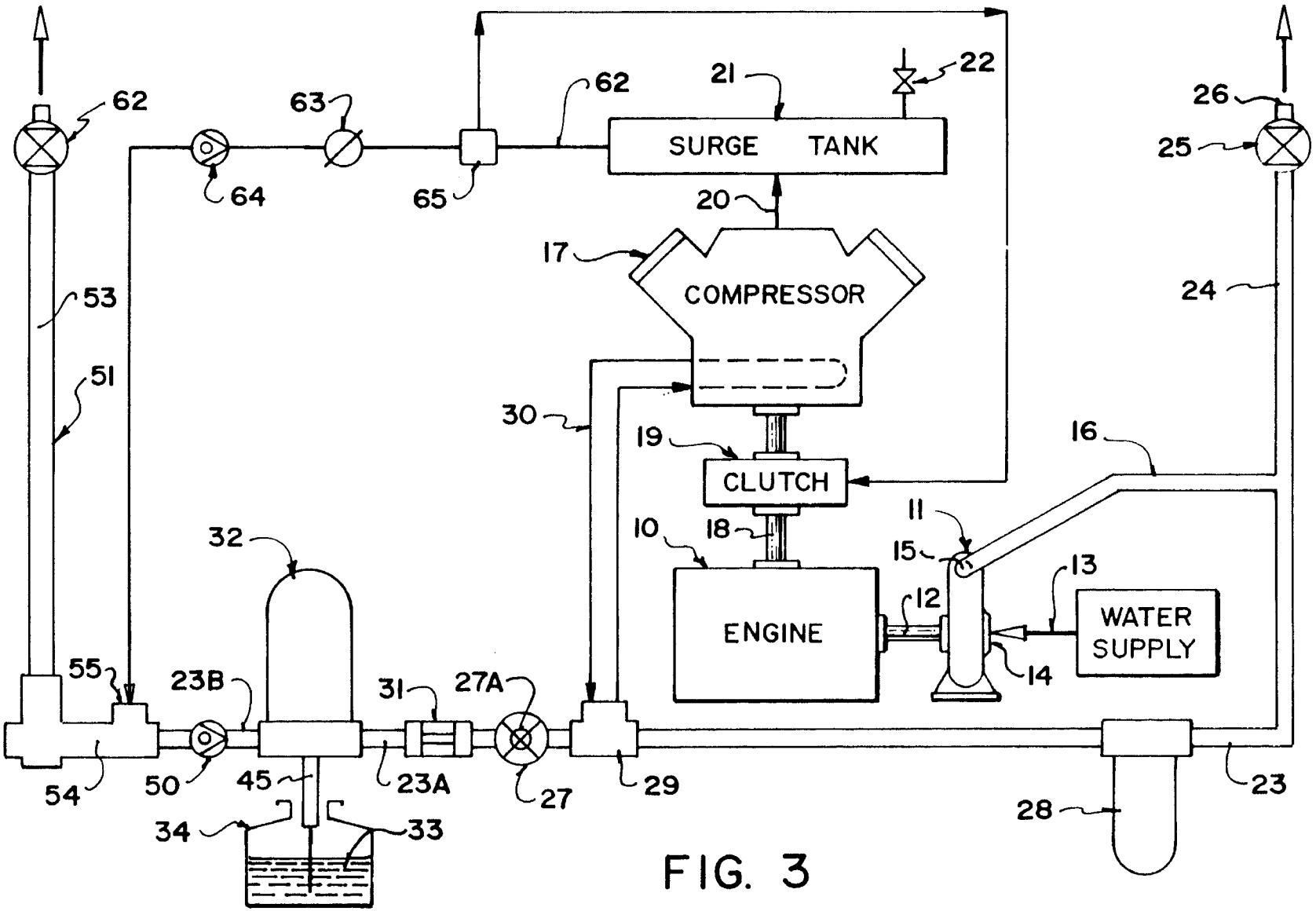
FIG. 3 is a schematic circuit layout of the apparatus showing the functional interconnection between the elements of the apparatus with the frame removed.

Turning firstly to FIG. 3 the operation components of the apparatus are shown schematically in a circuit diagram. The apparatus therefore comprises an internal combustion engine 10 which acts as a prime mover generating power for the components as described hereinafter. The apparatus further includes a pump 11 which is arranged to receive power from the engine 10 on a drive shaft 12. The pump connects with a water inlet 13 which can be a hose or a connection to a tank for receiving water into an inlet 14 of the pump. The pump generates a flow of water at an outlet 15 with the water being pressurized into a supply line 16 at the outlet 15.

The description of the embodiment herein relates to the use of water through the pump 11 but of course it will be appreciated that other liquids or water with various additives may be employed in the formation of the foam.

The apparatus further includes a compressor 17 which is a multi-piston single stage compressor as schematically illustrated. The compressor is driven by a shaft 18 which includes an electric clutch 19 by which the shaft can be disengaged from the compressor so that the compressor can be halted while the engine continues to run. The compressor acts to compress air from the intake (not shown) and compresses the air at an outlet 20 which is supplied from the outlet into a surge tank 21 in which the compressed air is collected and stored. The surge tank has a relief valve 22 for releasing excess pressure should this occur. The supply line 16 divides into a first foam supply line 23 and a second water supply line 24. The water supply line 24 includes a valve 25 which can be opened and closed to allow the release of water without foaming agent at an outlet 26 of the valve.

The foam supply line 23 includes a conventional water filter 28 so that the water supplied from the pump passes through the filter. The foam supply line further includes a bypass coupling 29 which diverts water from the supply line 23 into a cooling circuit 30 which passes water from the supply line 23 through the compressor to act as a cooling therefor.

Downstream of the coupling 29 is provided the valve 27. Downstream of the valve 27 is provided a fixed orifice control element 31 which defines a fixed orifice through which the water passes. The control system for the foam to provide dry, medium or wet foam consistency consists of the orifice 31 and the valve 27. The valve 27 includes a second orifice shown schematically at 27A so that the orifice 31 provides a rate of flow equal to a predetermined maximum flow. The orifice in the valve 27 controls the minimum flows. The valve itself varies the rate between the minimum and maximum flows. The control thus controls the rate of flow of the liquid and this automatically controls the injection of the chemical at the required rate in the required proportion to the liquid. These flows are therefore controlled in relation to the injection of compressed air to control the consistency of the foam generated.

From the orifice 31, the water passes to an injector 32 which extracts a foaming agent 33 from a container 34 for injection into the water within the supply line 23. The foaming agent is of a conventional nature generally known as a surfactant which is injected into the water in a required admixture rate lying in the range 0.2 to 10% by volume of the water.

Figure 4:
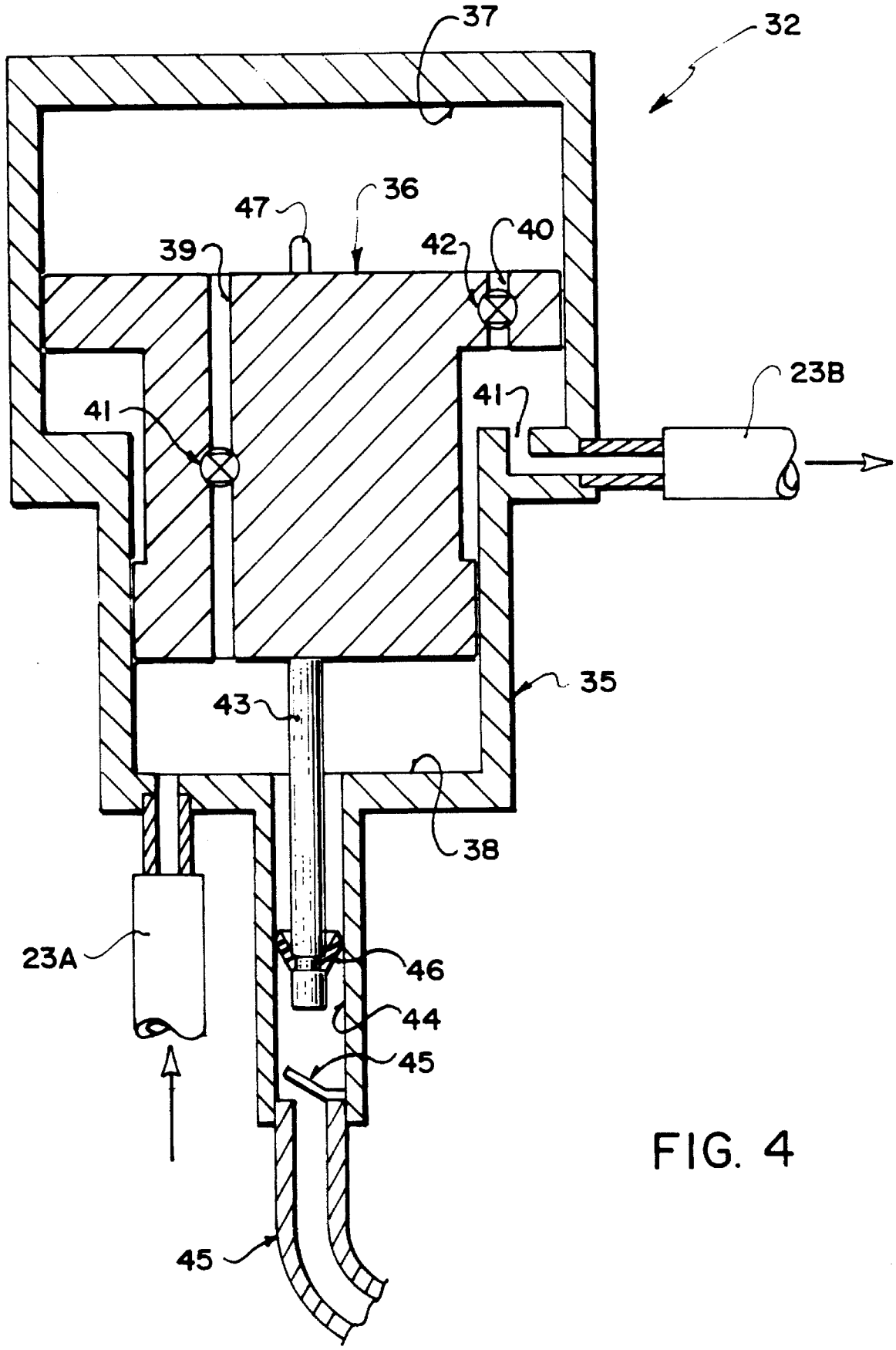
FIG. 4 is a schematic vertical cross sectional view through the injector of FIG. 3.

Further detail of the injector is shown in FIG. 4 where an inlet from the supply line is shown at 23A and an outlet to the supply is shown at 23B. The water from the supply line thus enters an interior chamber 35 of the injector and operates to move a piston 36 within the chamber 35. The chamber 35 is divided into two sections indicated at 37 and 38 respectively with the diameter of the chamber 37 being greater than that of the chamber 38. A passage 39 communicates with a piston 36 from the chamber 38 to the chamber 37. A second passage 40 communicates from the chamber 37 to an outlet 41 connected to the supply line 23B. Each of the ducts 39 and 40 is controlled by a valve 41, 42 respectively.

The piston 36 carries a rod 43 which extends longitudinally of the piston into a chamber 44 connected to a supply line 45 to the container 34. An end of the chamber 44 includes a flap valve 45 and the rod carries one way valve 46 on its outer surface.

Water pressure entering the chamber 38 from the supply line section 23A pushes the piston 36 upwardly so that the water enters and fills the chamber 38. The upward movement of the piston simultaneously pulls the rod 43 upwardly thus drawing into the chamber 44 past the valve 45 an initial supply of the chemical 33. During this upward movement of the piston, the valve 42 is opened so that the water in the chamber 37 is forced through the duct 40 to the outlet 23B.

When the piston reaches the upper most position, a switch 47 automatically operates the valves 41 and 42 so that the valve 41 is opened and the valve 42 is closed. In this condition the further supply of water from the inlet 23A passes through the duct 39 and in view of the pressure differential across the piston forces the piston downwardly. As the piston moves downwardly the rod 43 is also moved downwardly thus closing the flap valve 45 and forcing the chemical in the chamber 44 past the one way valve 46 into the chamber 38 to mix with the water flowing through the chamber 38 into the chamber 37.

Each reciprocation of the piston, therefore, draws into the water within the injector an amount of the chemical defined by the size of the chamber 44. The injector is thus powered by the pressure in the water and automatically supplies a predetermined volume of the chemical for each volume of the water which passes through the injector. The volume of the chemical can be varied by adjusting the size of the chamber 44 by an adjustment system (not shown).

Further detail of the type of injector used can be found in Canadian Patent 1,005,231 (Cloup) with the injector being available for purchase from Dosatron Inc.

Downstream of the injector 32 is provided a check valve 50 which prevents reverse flow should the pressure on the downstream side of the check valve at any stage exceed the pressure on the upstream side of the valve 50. From the check valve 50, the liquid entering the water and the chemical enters a mixing device generally indicated at 51.

Figure 5:
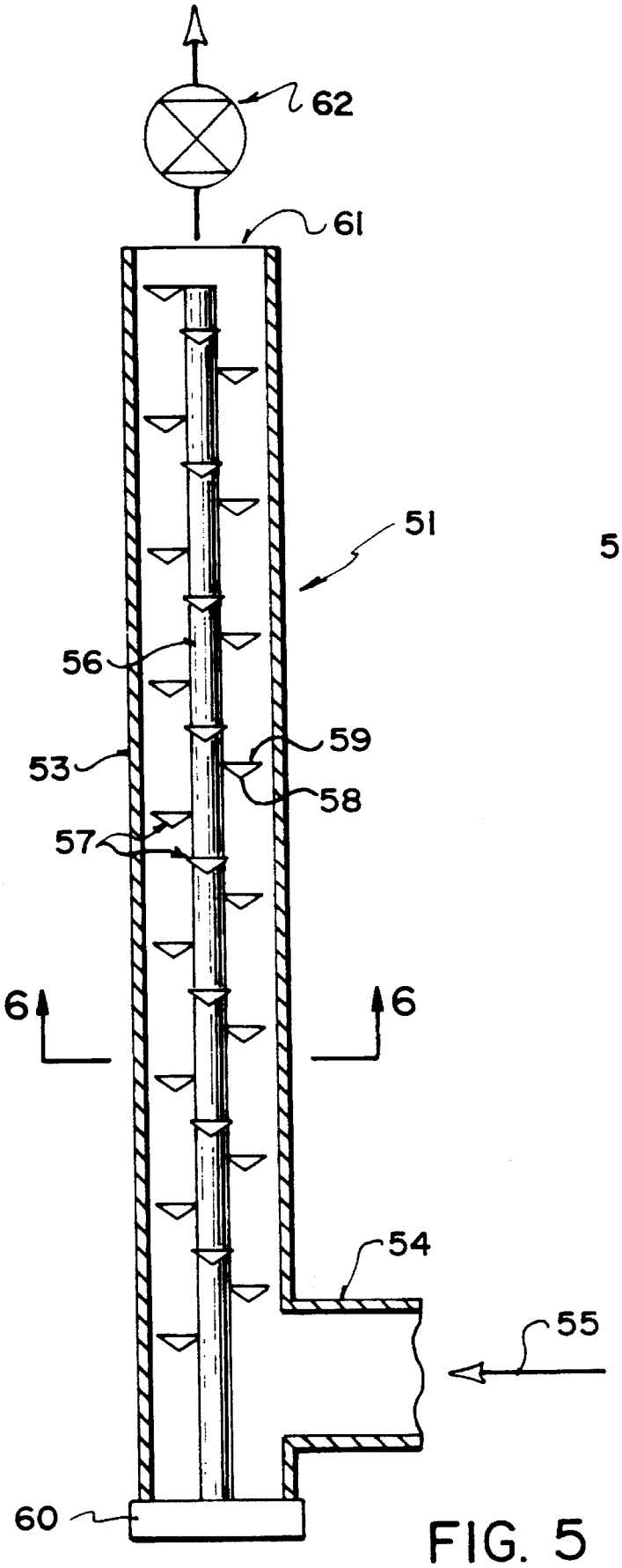
FIG. 5 is a vertical cross sectional view through the mixing chamber of FIG. 3.
Figure 6:
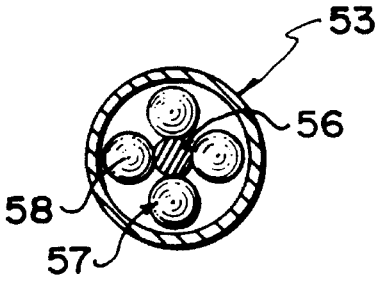
FIG. 6 is a cross sectional view along the lines 6—6 of FIG. 5.

The mixing device is shown in more detail in FIGS. 5 and 6 and comprises a tube 53 which extends vertically from, the inlet 54 downstream of the valve 50 and an inlet 55 from the air compressor. Within the tube 53 is provided a shaft 56 on which is mounted a plurality of baffles 57 arranged in spiral pattern around the shaft 56. Each baffle is conical in shape with an apex 58 at the bottom end and a base 59 at the upper end with an edge of the base welded to the shaft. The baffles are formed by punching a flat disk into the conical shape. The baffles are arranged in spiral position around the shaft from a lower end of the shaft which is attached to a cap 60 which closes the lower end of the tube 53 upwardly to a free end of the shaft adjacent the top end 61 of the tube 53. A valve 62 is arranged at the top end 61 and can be operated to control the release of the foam formed in the mixing chamber.

The compressor supplies air to the surge chamber 21 which controls surges and supplies the air to .an outlet line 62 at a constant pressure. A regulator 63 regulates that pressure to a required predetermined level for injection into the inlet 55. A. backcheck valve 64 prevents backflow of fluid from the mixing chamber 51. A pressure responsive switch 65 is responsive to a pressure in the surge chamber 21 exceeding a predetermined pressure and operates the clutch 19 to release drive from the power source 10 which can be an internal combustion engine or any other source such as a hydraulic motor. Thus if the supply of foam is closed off by operation of the valve 62, the compressor automatically is deactivated when the pressure reaches the required level to maintain the surge chamber at the supply pressure to the line 62.

Figure 1:
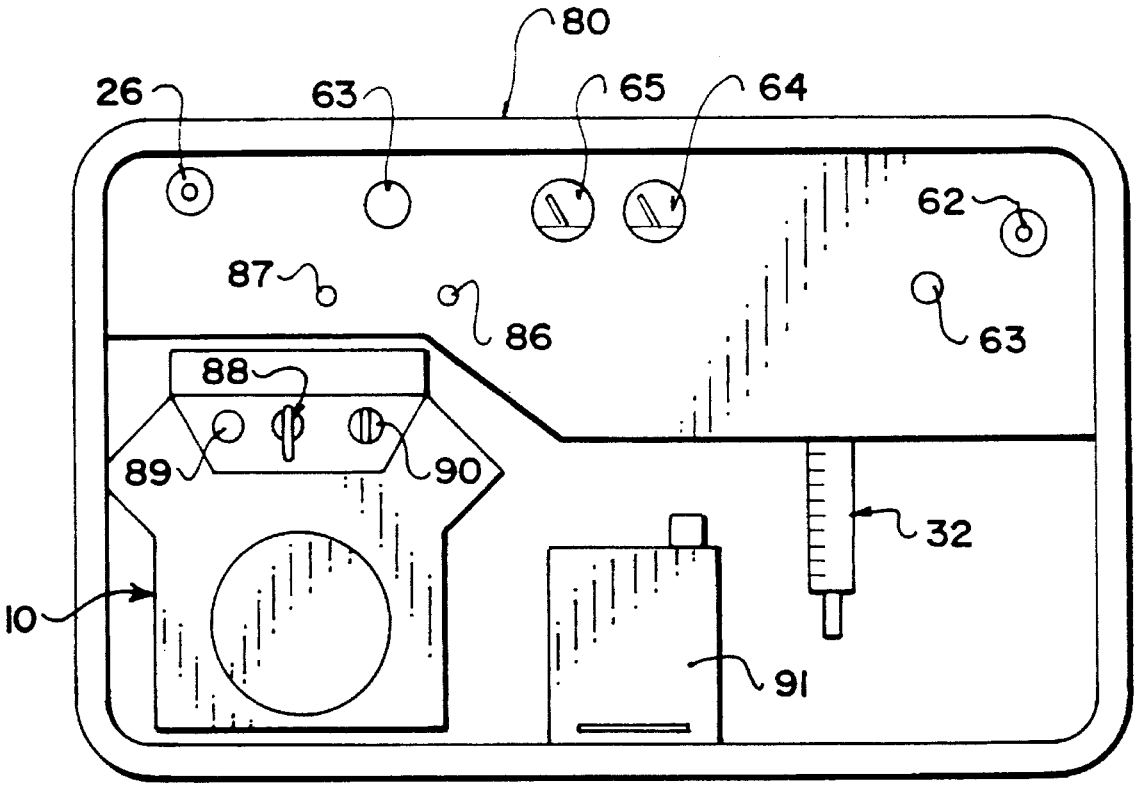
FIG. 1 is a front elevational view of the apparatus according to the present invention.
Figure 2:
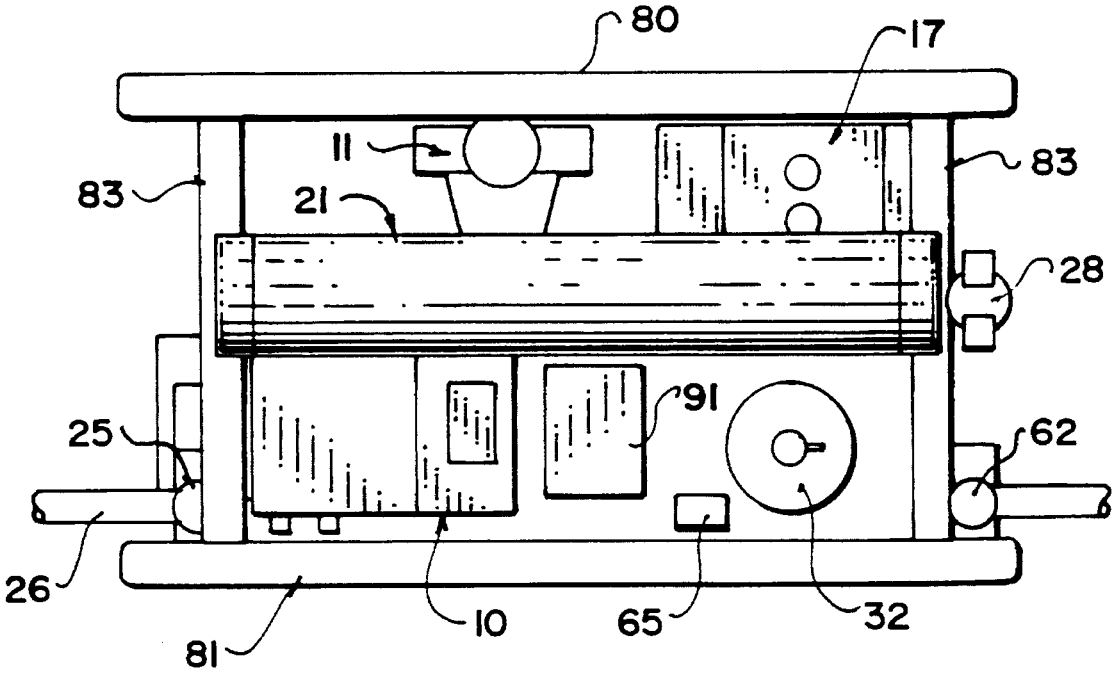
FIG. 2 is a top plan view of the apparatus as shown in FIG. 1.
Figure 7:
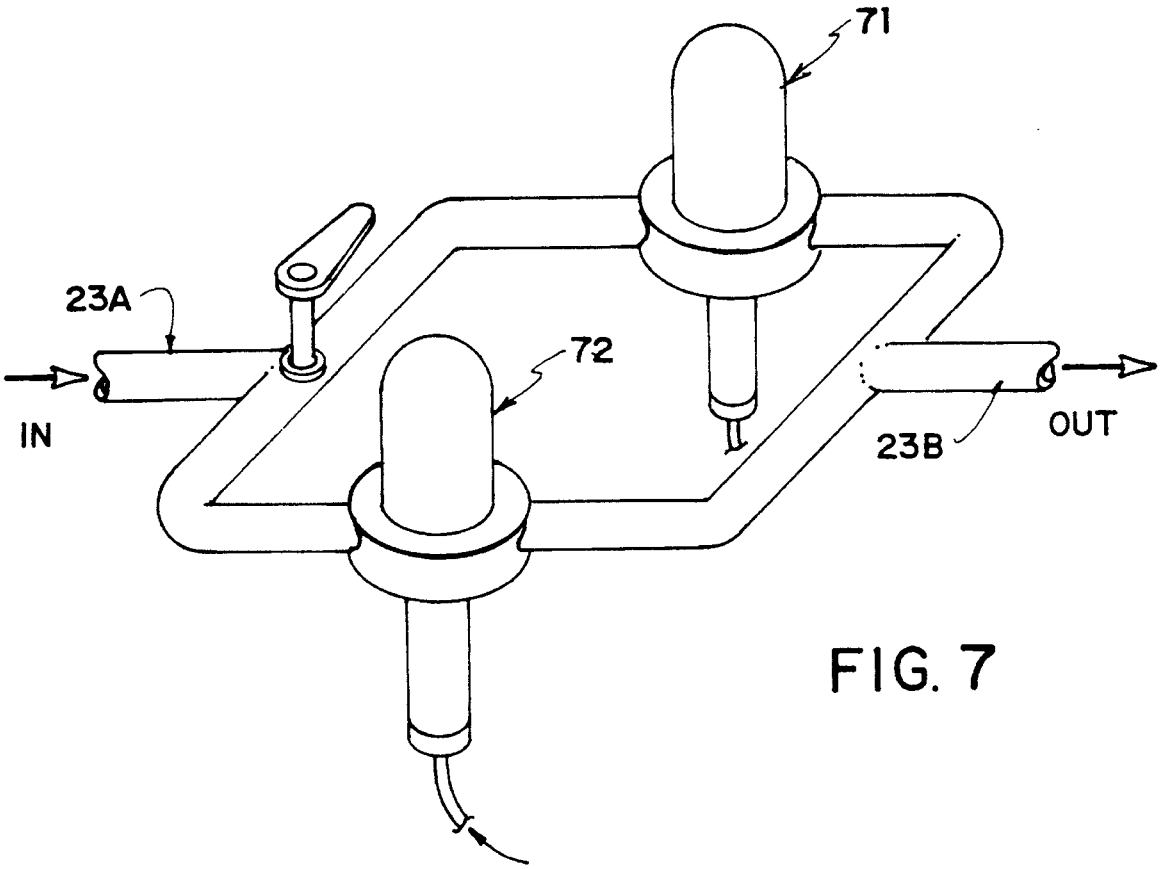
FIG. 7 is a schematic isometric view of a modification to the apparatus of FIG. 3 adding a second injector in parallel.
Figure 8:
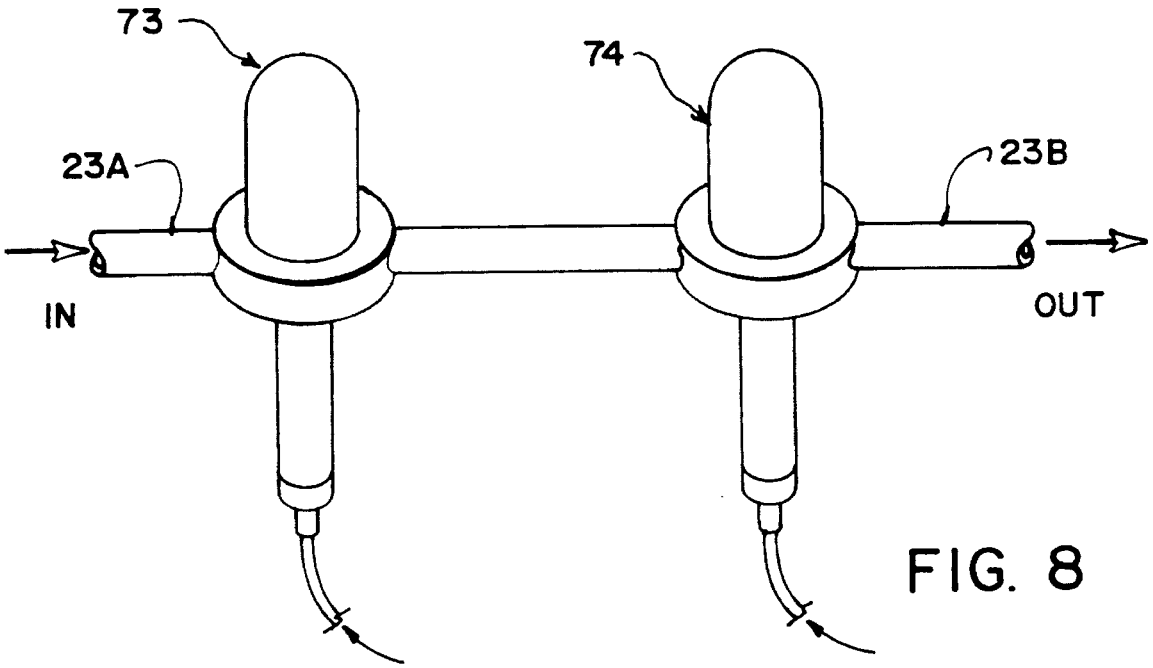
FIG. 8 is a schematic isometric view showing a modification of the apparatus of FIG. 3 in which there is added a second injector in series.

In FIGS. 7 and 8 there is shown alternative arrangements modified from the construction shown in FIG. 2. Thus in FIG. 7 is shown an arrangement in which two injectors 71 and 72 are arranged in parallel from the inlet line 23A to the outlet line 23B. In one case the injector 71 can be used as a low level injector in the range 0.2% to 2% and the injector 72 can be used in a high range from 2% to 10%. In another case the second injector can be used for an alternative injection chemical. In FIG. 8 two injectors are shown in parallel as indicated at 73 and 74. In FIGS. 1 and 2 is shown the general structure of the apparatus including an outer frame 80 and 81 in the form of a pair of loops of tubular metal which are interconnected by beams 83 to form a complete rectangular structure. The outlet for water is shown at 26 and the outlet for the foam is shown at 62. Reference numberal 63 shows an air regulator. Gauges for water and air pressure are indicated at 64 and 65. An air compressor switch is shown at 86. A light switch is indicated at 87. The air regulator 63 is shown on the frame between the light and air switches. The engine 10 includes a throttle 88, choke 89 and ignition switch 90. A battery 91 is provided for starting the engine in FIG. 2, the water pump 11 is arranged at one side frame 80.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. Apparatus for generating foam comprising:

a portable frame;

a pump mounted on the frame for pressurizing a liquid to be foamed having a pump inlet and a pump outlet;

a supply line connected to the pump outlet for receiving a flow of the liquid therefrom;

an injector mounted on the frame for a foaming agent connected into the supply so as to receive therein the liquid from the supply line, the injector including means responsive to the flow of liquid for pumping the foaming agent from a supply thereof into the liquid in the injector;

an air compressor mounted on the frame for generating a supply of air under pressure including a regulator for regulating the pressure;

an internal combustion engine mounted on the frame for driving the pump and the air compressor;

means for feeding the compressed air into the liquid;

mixing means for mixing the liquid, foaming agent and compressed air to generate the foam;

a pressure control valve responsive to pressure in the air from the air compressor;

and an electric clutch system mounted on the frame actuated by said pressure control valve for halting drive to the air compressor means, the electric clutch system being located between the engine and the air compressor to halt operation of the air compressor means while the engine continues to run.

2. Apparatus for generating foam comprising:

a pump for pressurizing a liquid to be foamed having a pump inlet and a pump outlet;

a supply line connected to the pump outlet for receiving a flow of the liquid therefrom;

an injector for a foaming agent connected into the supply so as to receive therein the liquid from the supply line, the injector including means responsive to the flow of liquid for pumping the foaming agent from a supply thereof into the liquid in the injector;

an air compressor for generating a supply of air under pressure;

means for feeding the compressed air into the liquid;

and mixing means for mixing the liquid, foaming agent and compressed air to generate the foam, the mixing means comprising:

an elongate tube having a central stationary shaft extending therealong such that the liquid, foaming agent and compressed air pass between the shaft and an inside surface of the tube;

and a plurality of individual baffle members fixed on the stationary shaft at angularly and axially spaced locations thereon for engaging and mixing the materials passing through the tube along the stationary shaft.

3. The apparatus according to claim 2 wherein the baffle members each comprise a conical element with an apex of the conical element facing toward an inlet end of the tube and a base of the conical element facing toward an exit end of the tube.

4. The apparatus according to claim 2 wherein the baffle members are arranged spirally of the shaft.

5. Apparatus for generating foam comprising:

a pump for pressurizing a liquid to be foamed having a pump inlet and a pump outlet;

a supply line connected to the pump outlet for receiving a flow of the liquid therefrom;

an injector for a foaming agent connected into the supply so as to receive therein the liquid from the supply line, the injector comprising a cylinder having a flow responsive piston mounted therein and responsive to the flow of liquid for moving the flow responsive piston by an amount directly proportional to the volume of liquid flowing and a pump piston directly driven by the flow responsive piston for pumping a volume of the foaming agent from a supply thereof, which volume is directly proportional to the volume of the liquid, into the liquid in the injector;

an air compressor for generating a supply of air under pressure;

means for feeding the compressed air into the liquid;

and mixing means for mixing the liquid, foaming agent and compressed air to generate the foam.

6. The apparatus according to claim 5 including a first fixed diameter orifice for limiting the minimum flow of the liquid, a second fixed diameter orifice for limiting the maximum flow of the liquid and a variable flow control valve operable to vary the rate of flow of the liquid so as to vary a consistency of the foam between wet, medium and dry.

7. The apparatus according to claim 5 including a second injector arranged in series with the first injector to allow the addition of a second chemical into the liquid.

8. The apparatus according to claim 5 including a second injector in parallel with the first injector, the second injector having a rate of injection higher than that of the first injector such that one of the first and second injectors can be selected for injecting a required rate of the foaming agent into the liquid.

9. The apparatus according to claim 5 including first valve means for closing off flow of the liquid through the injector and second valve means operable to open flow of the liquid to a liquid outlet.

10. The apparatus according to claim 5 wherein the supply line includes a cooling circuit in series therein for supplying liquid from the pump to the air compressor means.

11. The apparatus according to claim 5 wherein the pump, air compressor means, injector and mixing means are mounted on a common frame for transportation and wherein there is provided a power supply source mounted on the frame for driving the pump and the air compressor means.

12. The apparatus according to claim 5 wherein the air compressor means includes a regulator for regulating the pressure to said feeding means.

13. The apparatus according to claim 12 including a pressure control valve responsive to pressure in the air from the air compressor means and an electric clutch system actuated by said pressure control valve for halting drive to the air compressor means.

14. The apparatus according to claim 13 including an internal combustion engine for driving the pump and the air compressor means, the electric clutch system being located between the engine and the air compressor means to halt operation of the air compressor means while the engine continues to run.

15. The apparatus according to claim 5 wherein the mixing means comprises an elongate tube having a central stationary shaft extending therealone such that the liquid, foaming agent and compressed air pass between the shah and an inside surface of the tube and wherein the shaft carries a plurality of individual baffle members fixed on the stationary shaft at angularly and axially spaced locations thereon for engaging and mixing the materials passing through the tube along the stationary shaft.

16. The apparatus according to claim 15 wherein the baffle members each comprise a conical element with an apex of the conical element facing toward an inlet end of the tube and a base of the conical element facing toward an exit end of the tube.

17. The apparatus according to claim 15 wherein the baffle members are arranged spirally of the shaft.

* * * * *